US006578745B1

(12) United States Patent
Taylor et al.

(10) Patent No.: US 6,578,745 B1
(45) Date of Patent: Jun. 17, 2003

(54) REMOVABLE BELT CLIP

(75) Inventors: Stewart Taylor, Kingsport, TN (US); Robert Pierman, Gray, TN (US)

(73) Assignee: Taylor Cutlery, LLC, Kingsport, TN (US)

( * ) Notice: Subject to any disclaimer, the term of this patent is extended or adjusted under 35 U.S.C. 154(b) by 27 days.

(21) Appl. No.: 09/996,188

(22) Filed: Nov. 28, 2001

(51) Int. Cl.[7] ..... F41C 27/00
(52) U.S. Cl. ..... 224/197; 224/240; 224/669
(58) Field of Search ..... 224/197, 669, 224/240; 24/667

(56) References Cited

U.S. PATENT DOCUMENTS 4,419,794 A * 12/1983 Horton et al. ..... 24/667
5,185,906 A * 2/1993 Brooks ..... 24/35
5,452,497 A * 9/1995 Peng ..... 24/3.11
5,597,102 A 1/1997 Saarikko et al.
5,620,120 A * 4/1997 Tien ..... 224/199
5,730,342 A * 3/1998 Tien ..... 224/271
5,799,847 A * 9/1998 Sandor ..... 224/197
5,833,100 A * 11/1998 Kim ..... 224/197
6,059,156 A * 5/2000 Lehtinen ..... 224/197

* cited by examiner

*Primary Examiner*—Stephen P. Garbe

(57) ABSTRACT

An attachment device for attaching an implement, such as a knife, pager, telephone or the like onto a belt or other garment. The device includes a clip assembly for attachment to the belt, and includes a slot having an end portion circular in shape with a radius larger than the width of the slot. A pin fits into the slot only when at least one flat surface on the neck portion of the pin is parallel to one edge of the slot. The pin is allowed to rotate via the circular shape and the pin having a stem diameter corresponding the circular shape. This provides a locking mechanism where the narrower width of the slot prevents the pin from exiting the slot unless the instrument is turned a specific angle.

13 Claims, 2 Drawing Sheets

REMOVABLE BELT CLIP

FIELD OF THE INVENTION

This invention relates to a device for attaching an implement or instrument, such as a knife, telephone, pager, and the like to the apparel of a user.

BACKGROUND OF INVENTION

A user of various hand held instruments has several options for clipping those instruments to his or her belt or the like when the user is not immediately using them. A common method is to insert the instrument into a case rigidly clipped to the user's belt. Other clips attach directly to the instrument itself Such designs are often found not to be practical or convenient in that they typically are intrusive.

Other designs for holding such instruments allow for rotation of the instrument. U.S. Pat. No. 5,597,102 discloses a design that holds a phone via a flanged lug fastened on the back side of the phone. The lug slides into a slot on a clip via the flanges that can be fastened to a person's belt. When the lug is at the deepest part of the slot, a spring activated projection acts on the lug to keep it from sliding from the slot. This design allows for the phone to rotate while in the slot, which can alleviate the discomfort of a rigid clip. However, the clip design has disadvantages. First, the rotational forces on the phone can cause the phone to dislodge. Also, even without rotating the phone, a tug on the phone towards the opening of the slot can overcome the spring acting on the projection to release the phone.

SUMMARY OF INVENTION

It is thus an object of the present invention to provide a clip for hand held instruments which overcomes the before mentioned problems associated with previous designs.

To attain this object, the invention provides a clip design that allows an instrument to be removably attached to the clip. The clip attaches the belt of the user using two opposing members pulled together by a u-shaped spring metal-plate. The instrument attaches to the clip via a pin fitted into a slot on the clip. The pin has a head and a stem portion for being held in the slot of the clip. The diameter of the pin stem is greater than the width of the slot, but has two opposing flat surfaces whereby the pin stem may fit into the slot only when the pin is rotated to a certain angle. At the end of the slot, the slot has a circular shape with a diameter corresponding to the diameter of the round portion of the pin stem. This allows for the pin to rotate in the clip.

To remove the instrument from the clip, the instrument must be rotated to a horizontal position, or where the flat surfaces are parallel to the narrow portions of the slot, then the instrument may be slid out of the slot.

The clip design provides a locking mechanism to lock the pin into place. The diameter of the pin being greater than the width of the slot provides a means whereby the instrument cannot be pulled from the clip, except when rotated to a certain angle. This helps alleviate the problem of the instrument from becoming dislodged from the clip.

The design also provides for a clip whereby the instrument can rotate even when it is locked into place. This helps overcome the problems in the prior art by helping alleviate the discomfort associated with a rigid attachment device design by allowing the instrument to rotate to another position while sitting or walking.

BRIEF DESCRIPTION OF THE DRAWINGS

A preferred embodiment of the invention will now be described with reference to the accompanying drawings, in which.

DETAILED DESCRIPTION OF THE DRAWINGS

Figure 1:
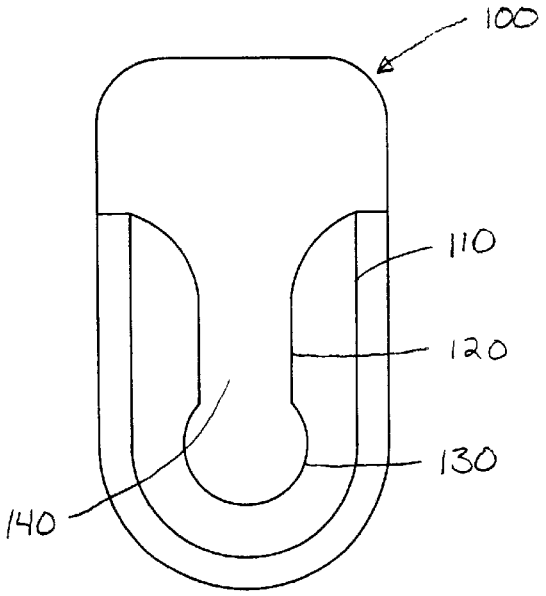
FIG. 1 is a front view of the clip.

In FIG. 1. there is disclosed a front view of the clip 100 according to the present invention. The main features of the clip disclosed are the first slot 110 and the second slot 140 with a first width 120 and a second width 130, which has a diameter greater than the first width 120.

Figure 2:
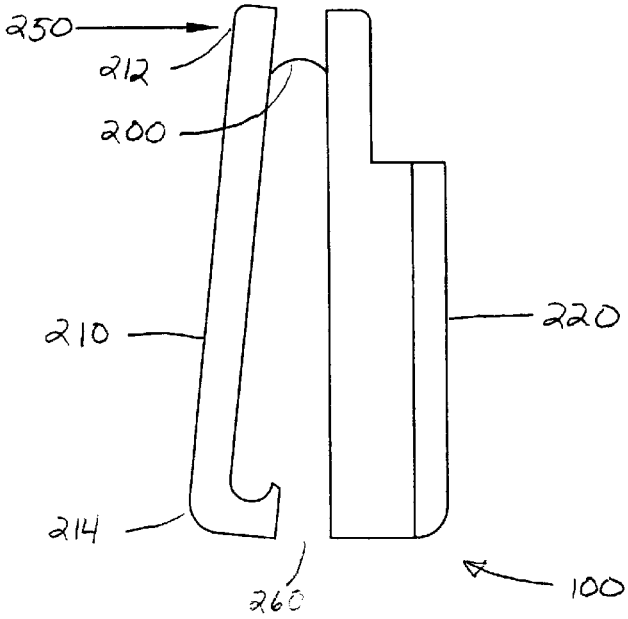
FIG. 2 is a side view of the clip showing how the clip is attached to a garment.

FIG. 2 shows the operation of the clip to place the clip on a belt or the like. The clip 100 has a front member 220 and an opposing rear member 210. Between them is a u-shaped spring metal plate 200 which is attached to the rear side of the front member 220 and is also attached to the front of the rear member 210. Upon pressing the rear member 210 at its upper portion 212 in the direction shown by arrow 250, the bottom portion 214 of rear member 210 moves away from the front member 220. A belt, a portion of clothing or the like may be inserted in the gap 260 created between bottom portion 214 and the front member 220. Upon interrupting the pressing of the upper portion 212, the spring metal plate 200 pulls the front member 220 and the rear member 210 together to firmly hold the clip 100 on the belt or clothing.

Removal of the clip from the belt or the like requires pressing once again the upper portion 212 to cause the separation between the bottom portion 214 and the front member 220 to again form gap 260. The clip 100 is then moved away from the belt or the like, and then the user may cease the pressing of the rear member 210.

Figure 5:
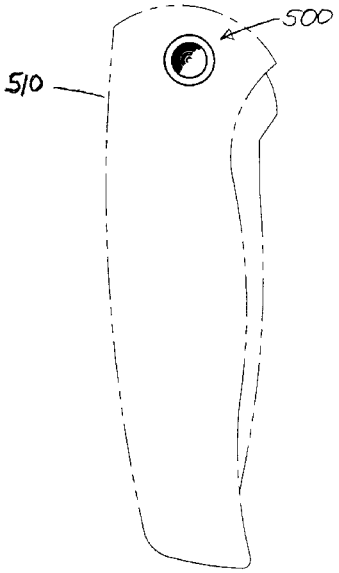
FIG. 5 is a top view of the locking pin and a phantom view of the knife.
Figure 6:
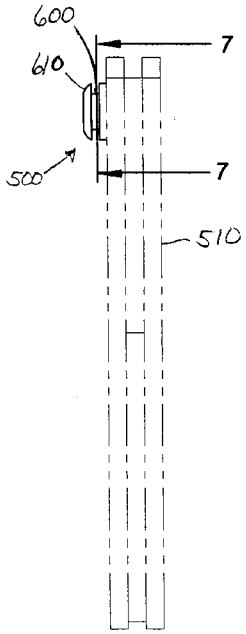
FIG. 6 is a side view of the locking pin and a phantom view of the knife.
Figure 7:
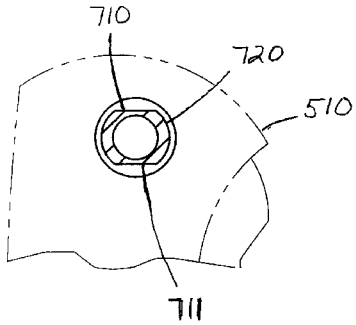
FIG. 7 is a cross sectional view along line 7—7 of FIG. 6.

FIG. 5, FIG. 6 and FIG. 7 show the design of the pin 500 mounted on a knife 510, shown in phantom view. The knife will not be described as such knives are well known in the art. Further, the pin may be attached to any device or instrument, such as a phone, pager, tool, etc. The knife is used by way example. The pin has a head portion 610 and a stem portion 600. The stem portion 600 comprises a round portion 720 which has a radius corresponding to the radius of the second width 130 of the second slot 140 and opposing parallel flat portions 710 and 711 which between them have a width corresponding to the width of the first width 120 of the second slot. The head portion 610 has a diameter greater than the second width 130 of the second slot.

Figure 3:
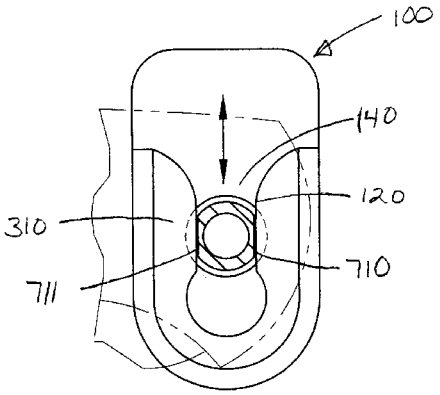
FIG. 3 is a front view of the clip and a phantom view of the knife during insertion of the locking pin.
Figure 4:
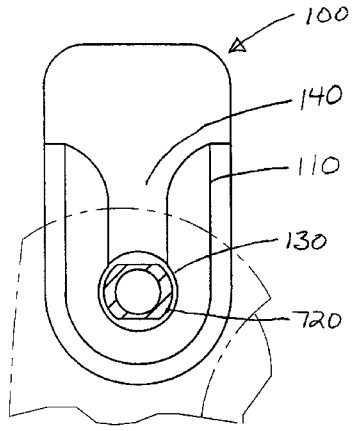
FIG. 4 is a front view of the clip and a phantom view of the knife when the locking pin of the knife is in the locked position.

FIG. 3 and FIG. 4 show the operation of the clip in association with the pin. When the user wishes to place the instrument into the clip, the pin 500 must be placed into the first width 120 of the second slot 140. The head portion 610 is fits beneath the surface 310 surrounding the second slot 140, the head portion having a greater diameter than the first width 120 and the second width 130 of the second slot 140, while the stem portion is associated with the second slot 140. The round portion 720 of the pin 500 has a radius greater than the first width 120, since the radius of the round portion 720 corresponds to the radius of the second width 130, which is greater than the first width 120. Thus, the pin 500 and thus the knife must be rotated until the knife is horizontal to the clip, as shown in FIG. 3. This aligns the flat portions 710 and 711 of the pin with the first width 120, which have corresponding dimensions. Then the pin 500 may slide into the first width 120 of the second slot 140.

Once the pin 500 reaches the second width 130, the pin is also allowed to rotate because the diameter of the second width 130 corresponds to the diameter of the round portion 720, which allows for rotational movement. The diameter of the round portion 720 being greater than the first width 120 of the second slot 140 also prevents the pin 500 from moving away from the second width 130, except at the exact position when the flat portions 710 and 711 line up with the first width 120. Thus, there is provided a locking mechanism to prevent the dislodging of the knife from the clip while at the same time allowing rotational movement.

The release of the knife from the clip requires a rotation of the knife 510 and movement of the pin from away from the second width 130. The knife must be rotated so it is horizontal with respect to the clip 100, as shown in FIG. 3. This aligns the flat portions 710 and 711 with the first width 120 of the second slot 140. Once aligned, the pin 500 may freely move away from the second width 130 through the first width 120, out the second slot 140 and be removed from the clip 100 for use.

The forgoing describes an embodiment using a knife. The invention may be used with other instruments or devices, such as phones, pagers, tools, etc. Further, other embodiments of the present invention, and obvious modifications to those skilled in the art can be made without departing from the scope of the present invention.

We claim:

1. An assembly attachable to the attire of a user comprising:

a first member including means for detachably securing said first member to a selected portion of said attire, a first slot having a given width along the length thereof and a second slot communicating with said first slot, said second slot having a first width along a portion thereof less than the width of said first slot and a second width at an end thereof less than the width of said first slot and greater than said first width of said second slot;

a second member having a laterally projecting pin including a stem portion and a head portion;

said stem portion having a first width no greater than said first width of said second slot and a second width angularly displaced from said first width of said stem relating to a centerline of said stem, greater than said first width of said second slot and less than the second width of said second slot; and said head portion having a width no greater than the width of said first slot and greater than said first and second widths of said second slot.

2. The assembly according to claim 1, wherein said first width of said stem portion comprises two flat surfaces parallel to each other.

3. The assembly according to claim 1, wherein said first width of said stem portion comprises at least one flat surface.

4. The assembly according to claim 1, wherein the second width of said second slot has a circular shape corresponding to the second width of said stem portion of said pin.

5. The assembly according to claim 4, wherein the center of the circular shape of the second width of said second slot is located along a centerline of said first slot.

6. The assembly according to claim 1, wherein said means for detachably securing comprises a front member hinge connected to a rear member.

7. The assembly according to claim 6, wherein said front and rear members are connected by a u-shaped spring-metal plate biasing said front and rear members towards each other.

8. The assembly according to claim 1, wherein the first slot and the second slot extend along parallel centerlines.

9. An assembly attachable to the attire of a user comprising:

a first member including means for detachably securing said first member to a selected portion of said attire comprising a hinge connected front and rear member, a first slot having a given width along the length thereof and a second slot communicating with said first slot, said second slot having a first width along a portion thereof less than the width of said first slot and a second width at an end thereof less than the width of said first slot and greater than said first width of said second slot;

a second member having a laterally projecting pin including a stem portion and a head portion;

said stem portion having a first width no greater than said first width of said second slot and a second width angularly displaced from said first width of said stem relating to a centerline of said stem, greater than said first width of said second slot; and said head portion having a width no greater than the width of said first slot and greater than said first and second widths of said second slot.

10. The assembly according to claim 9, wherein said first width of said stem portion comprises at least one flat portion.

11. The assembly according to claim 9, wherein said first width of said stem portion comprises two flat surfaces parallel to each other.

12. The assembly according to claim 11, wherein said stem portion slides along said first width of said second slot only when said flat surfaces are substantially parallel to said first width of said second slot.

13. The assembly according to claim 9, wherein the second width of said second slot is a circular shape which communicates with the second width of said stem portion of said pin.

* * * * *